United States Patent [19]

Leonard

[11] 4,404,819

[45] Sep. 20, 1983

[54] VALVED CRYOGENIC DEWAR

[75] Inventor: Rex D. Leonard, Indianapolis, Ind.

[73] Assignee: International Cryogenics, Inc., Indianapolis, Ind.

[21] Appl. No.: 398,745

[22] Filed: Jul. 16, 1982

[51] Int. Cl.[3] ..... F25B 19/00

[52] U.S. Cl. ..... 62/514 R; 137/587; 251/114; 220/420

[58] Field of Search ..... 62/514 R; 251/144; 137/587, 589; 220/420

[56] References Cited

U.S. PATENT DOCUMENTS

| | | | |
|---|---|---|---|
| 2,834,377 | 5/1958 | Bragg | 251/144 |
| 3,025,680 | 3/1962 | De Brosse et al. | 62/514 R |
| 3,062,506 | 11/1962 | Dicker | 251/144 |
| 3,611,746 | 10/1971 | Marsing | 62/514 R |
| 4,209,163 | 6/1980 | Nordskog | 251/144 |

*Primary Examiner*—Ronald C. Capossela

*Attorney, Agent, or Firm*—Hume, Clement, Brinks, Willian & Olds

[57] ABSTRACT

A cryogenic dewar includes openings at the top and bottom of the cryogenic fluid container. A valve is provided at the bottom of the container to control the flow of cryogenic fluid into and out of the container. The valve includes a valve body forming at least one passageway from the container to the opening at the container bottom and a valve seat therebetween. A valve closure is provided to engage and seal the valve seat. A rod, having the valve closure at its lower end, is supported by the body within the cryogenic fluid container and extends upwardly to adjacent the opening at the top of the container. A valve actuator for said rod is carried in an upper opening and is adapted to engage the rod at its upper end, to operate said valve closure, and to be removable from the upper opening.

6 Claims, 3 Drawing Figures

VALVED CRYOGENIC DEWAR

This invention relates to a novel dewar for containing cryogenic fluids, and more particularly, to a cryogenic dewar including a valve for controlling the flow of cryogenic fluids into and out of the dewar.

Cryogenic dewars are known. Such dewars are disclosed, for example, in U.S. Pat. Nos. 2,943,454; 2,945,354; 2,958,204; 2,964,919; 2,970,452; 3,097,497; 3,152,589; 3,183,678; 3,186,406; 3,205,670; 3,318,307; 3,570,481; and 3,707,078. The above patents disclose dewars having openings at the top and at the bottom, but none include a simple and inexpensive manually controlled valve to control the flow of cryogenic fluid into and out of the inner container of the dewar.

This invention provides a valved cryogenic dewar with a novel structure, permitting control of the flow of cryogenic fluid into and out of the inner container by means of the manually operated valve adjacent the bottom of the inner container. A cryogenic container of this invention includes an inner container for the cryogenic fluids and an outer casing surrounding the inner container and being sealed to the inner container to define a vacuum space between the inner container and outer casing. The vacuum space includes thermal insulation and reduces the transfer of heat from the surrounding atmosphere to the inner container to increase the time that cryogenic fluids may be maintained within the dewar. The container includes a first opening between the inner container and outer casing at the bottom formed by a first means and a second opening between the inner container and outer casing at the top formed by a second means. The valve is located at the bottom of the inner container to control the flow of cryogenic fluid through the first means forming the opening at the bottom of the dewar. The valve includes a body forming at least one passageway from the inner container to the first means and a valve seat therebetween. The valve further includes a valve closure adapted to engage and seal the valve seat. The valve closure is at the lower end of a rod. The rod is supported within the container by the body at its lower end. A valve actuator is carried in the second means. The valve actuator engages the rod at its upper end and is operable to open and close the valve. The actuator is removable from the second means to permit the addition or removal of cryogenic fluids to the inner container through the second means.

In a preferable embodiment, the first and second means and their openings are coaxial with the central axis of the inner container. Second means is preferably formed by a cylindrical tubular member adapted to be sealed between the inner container and the outer casing. In this preferred embodiment, the body includes a threaded bore leading to the valve seat, with at least one passageway from the inner container intercepting the threaded bore above the valve seat. The valve closure is threaded and engages the threaded bore of the body to close the passageway and seal the valve seat. The actuator includes a cylindrical core of thermal insulating material that is journalled within the cylindrical tubular member of the second means so that rotation of the actuator thus opens and closes the valve. The actuator may carry, within the cylindrical core of insulating material, a metal tube having a slot at its lower end. The rod may be provided with a transverse projecting pin, and the actuator may, upon placement in the second means, operate the rod by engagement of the slot of its metal tube with a transverse projecting pin.

These features and others are illustrated in the following drawings in which.

Figure 1:
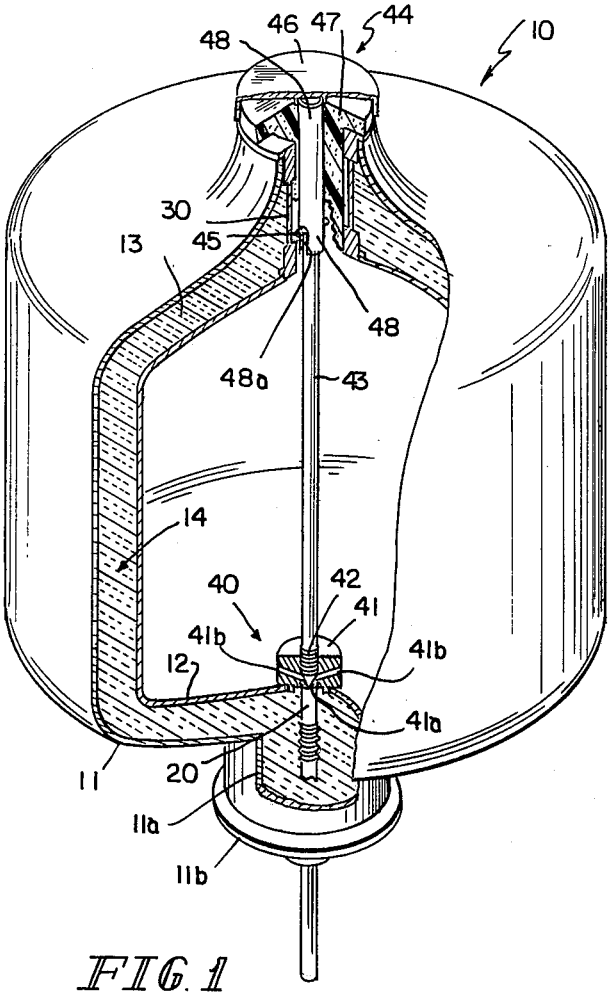
FIG. 1 is a perspective view of the valved cryogenic dewar of this invention, partially broken away to show the valve structure within the dewar.

FIG. 1 illustrates the structure of a valved cryogenic dewar of this invention. The valved dewar 10 includes a rigid outer casing 11 and an inner container 12. In the embodiment shown, the outer casing 11 includes at its lower portion a cylindrical portion 11*a* and a plate 11*b*.

A first means 20 forms an opening between the inner container 12 and the outer container 11 at the bottom of the dewar. The first means 20 is preferably a metal tube with an accordian portion 202 to accommodate thermal expansion and contraction. A second means 30 forms an opening between the inner container 12 and the outer casing 11 at the top of the dewar.

The parts defining the inner container and the outer casing, including the first and second means and any intervening parts, are welded together to define a vacuum space 13 between the inner container and the outer casing. The vacuum space 13 is preferably filled with thermal insulation 14. The combined action of the thermal insulation 14 and the vacuum between the inner container and the outer casing insulate the inner container 12 from the surrounding atmosphere, thereby permitting cryogenic fluids to be maintained for substantial periods of time.

Figure 2:
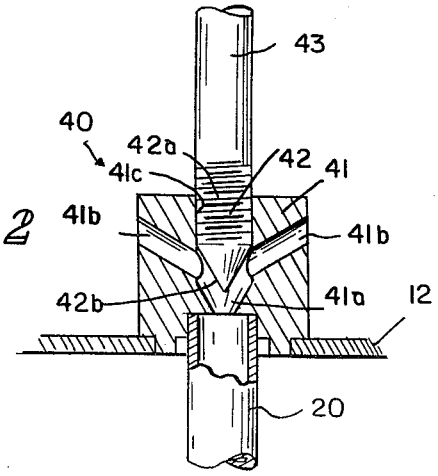
FIG. 2 is a lower portion of the cryogenic dewar to show the valve body in this structure.

As shown in FIG. 1, dewar 10 carries a manually operated valve 40 at the lower end of the inner container 12. The details of valve 40 are more particularly illustrated in FIG. 2. The valve 40 includes a body 41 and a valve closure 42. The valve body 41 and valve closure 42 are preferably made from materials having the same coefficient of thermal expansion and may be made from brass. The valve body 41 forms a valve seat 41*a* and at least one passageway 41*b* leading from within the inner container 12 through the valve seat 41*a* to the opening of first means 20. In the embodiment shown in FIG. 2, two passageways 41*b* are shown. The body 41 also forms a threaded bore 41*c*, and the passageways 41*b* intercept the threaded bore 41*c* above the valve seat 41*a*. The valve closure 42 is threaded at its outer surface 42*a* to engage the threaded bore 41*c*. The lower end 42*b* of the valve closure 42 is adapted to engage and seal valve seat 41*a*.

Thus, as valve closure 42 is turned in one direction, it may be advanced in the direction of the threads so that it closes passageways 41*b* and seats and seals upon valve seat 41*a*, preventing the flow of fluids from within container 12 through the first means 20. When flow is desired, the valve closure 42 may be rotated in the other direction, retracting its lower end 42*b* from valve seat 41*a* and opening passages 41*b* to permit flow either into or out of the inner container 12 through the first means 20.

The valve closure 42 is formed on and actuated by a rod 43 within the container 11. The structure by which the upper end of the rod 43 is actuated is more particularly shown in FIG. 3.

The upper end of the rod 43 extends adjacent the top of the inner container 12. The upper end of the rod 43 is engaged by actuator 44. The rod is provided with a pin 45 transversely through the rod 43 providing projecting portions 45*a*. The actuator includes an upper surface 46 adapted for manual operation, a central core 47 of thermally insulated material (such as styrofoam) and a central metal tube 48 having a slotted lower end adapted to provide engaging surfaces for the projecting portions 45*a* of pin 45.

In the preferable embodiment, the second means 30 is a somewhat open cylindrical tubular member adapted at its upper end to provide a surface 31 to be welded and sealed with the outer casing 11 and a surface 32 at its lower end to be welded and sealed with the inner container 12. The central core 47 of valve actuator 44 is journalled within the cylindrical member 30.

Rotation of the valve actuator surface 46 and tube 48, through the surfaces forming the slots 48*a* in metal tube 48, drives the projecting portions 45*a* of pin 45 and rotates rod 43 and the valve closure 42 to operate thereby the valve.

Figure 3:
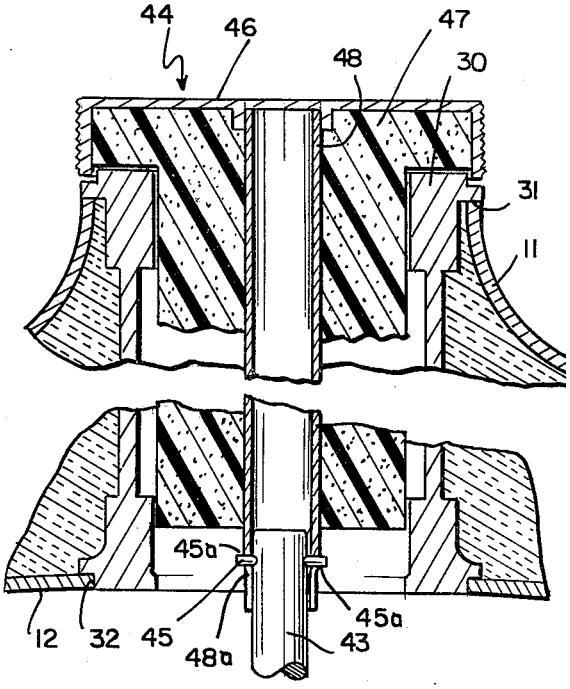
FIG. 3 is a cross-sectional view of an upper portion of the cryogenic dewar to show the structure of the actuator for the valve.

As shown in FIG. 1, the valve for dewar 10 may be placed coaxially on the central axis of the inner container 12. The first means 20 may be welded to the valve body 41, and the inner container 12 may be welded to the valve body 41 to locate the valve body 41 and first means 20 coaxially within the inner container 12. The valve closure 42 and rod 43 can thus be located along the central axis of the inner container. The second means 30 may be a machined cylindrical member having projecting bosses 31 and 32 permitting it to be conveniently welded to and sealed with the outer casing 11 and the inner container 12, respectively. The inner surface of cylindrical member 30 may be located coaxial with the central axis of the inner container and provide a convenient bearing surface for the valve actuator 44. As shown in FIGS. 1 and 3, the valve actuator 44 may be removed by simply lifting it vertically from the second means 30. With the valve actuator 44 removed, cryogenic liquid may be added to the inner container 12 through the second means 30.

Thus, the dewar of this invention is provided with openings at the top and the bottom through which fluids may be either added or removed. The opening at the bottom of the dewar is provided with a valve at the bottom of the container to control the flow of fluid into and out of the container. The valve is manually operable by means of a rotatable valve actuator that is removably and rotatably carried within the opening at the top of the dewar.

The valve dewar of the drawings is a preferred embodiment, and other valve dewars may be devised without departing from the scope of the following claims.

What is claimed is:

1. A cryogenic dewar, comprising an inner container for cryogenic fluids, and an outer casing surrounding the inner container and being sealed to said inner container to define a vacuum space therebetween, said vacuum space carrying thermal insulation to impede the transfer of heat from the surrounding atmosphere to the inner container, first means forming an opening between the inner container and the outer casing at the bottom of the dewar and second means forming an opening between the inner container and the outer casing at the top of the dewar, a valve at the bottom of the inner container to control the flow of cryogenic fluid through said first means, said valve including a valve body forming at least one passageway from the inner container to said first means and a valve seat therebetween, and including a valve closure adapted to engage and seal the valve seat, a rod having the valve closure at its lower end and being supported by the body within the inner container, a valve actuator for said rod carried in said second means, said valve actuator being adapted to engage the rod at its upper end and to operate said valve closure and to be movable from said second means.

2. The cryogenic dewar of claim 1 wherein said first means and said second means are coaxial with the central axis of the inner container, and said second means is formed by a cylindrical tubular member adapted to be sealed between the inner container and the outer casing, the valve body includes a threaded bore leading to said valve seat with said at least one passageway from the inner container intercepting the threaded bore above the valve seat, the valve closure is threaded and engages the threaded bore of said body and is adapted to close the at least one passageway and seal the valve seat, the actuator includes a cylindrical core of thermally insulative material that is journalled within the cylindrical tubular member of said second means so that its rotation may open and close the valve.

3. The cryogenic dewar of claim 2 wherein the actuator carries a metal tube within the cylindrical core, said metal tube having a slot at its lower end, and the rod has a transverse projecting pin above the bearing, said slot of the metal tube engaging the transverse projecting pin when the actuator is placed within the second means.

4. The cryogenic dewar of claim 1 wherein said valve body has a threaded bore leading to said valve seat and a pair of lateral passageways leading from the sides of said valve body to said bore, and wherein said valve closure is threaded and engages said threaded bore to permit the valve closure to close the lateral passageways and seal the valve seat when the valve closure is advanced in one direction and to open the passageways and the valve seat when it is retracted in the other direction.

5. The cryogenic dewar of claim 1 or 4 wherein the rod to actuate the valve closure has an extending surface at its upper end, and said actuator has a member adapted to engage the extending surface of the rod to permit it to move the rod and open and close the valve.

6. The cryogenic dewar of claim 4 wherein said rod has a projecting pin, the actuator has a cylindrical core of insulative material that is journalled in the second means and a tubular central member having a slot at its lower end adapted to engage the projecting pin.

* * * * *